United States Patent [19]

Sun et al.

[11] 4,007,777

[45] Feb. 15, 1977

[54] SWITCHABLE HEAT PIPE ASSEMBLY

[75] Inventors: Tsu Hung Sun, Torrance; Algerd Basiulis, Redondo Beach, both of Calif.

[73] Assignee: Hughes Aircraft Company, Culver City, Calif.

[22] Filed: July 2, 1975

[21] Appl. No.: 592,448

[52] U.S. Cl. ..... 165/32; 165/105

[51] Int. Cl.[2] ..... F28D 15/00

[58] Field of Search ..... 165/32, 105, 96

[56] References Cited

UNITED STATES PATENTS

| | | | |
|---|---|---|---|
| 3,587,725 | 6/1971 | Basiulis | 165/32 |
| 3,621,906 | 11/1971 | Leffert | 165/32 |
| 3,776,304 | 12/1973 | Auerbach | 165/105 X |
| 3,818,980 | 6/1974 | Moore, Jr. | 165/32 |

OTHER PUBLICATIONS

Eastman, G. Y. *Heat Pipe—A Progress Report* RCA/Electronic Components, Lancaster, Pa. (17604), 12/1969, Paper No. ST-4048.

*Primary Examiner*—Albert W. Davis, Jr.
*Attorney, Agent, or Firm*—Lewis B. Sternfels; W. H. MacAllister

[57] ABSTRACT

The heat pipe assembly is formed into an H-shape or a Y-shape. The H-shaped configuration comprises two heat pipes, each having condenser and evaporator sections with wicking therein coupled by a tube with wick at their evaporator sections. The Y-shaped configuration utilizes a common evaporator section in place of the two evaporator sections of the H-shaped configuration. In both configurations, the connection between the vapor spaces of the two heat pipes equalizes vapor pressure within the heat pipes. Although both heat pipes have wicks, they have sufficient fluid only to saturate a single pipe. If heat is applied to the condenser section of one of the pipes, this heat pipe becomes inoperative since all the fluid is transferred to the second pipe which can operate with a lower thermal load.

7 Claims, 6 Drawing Figures

Fig. 1.
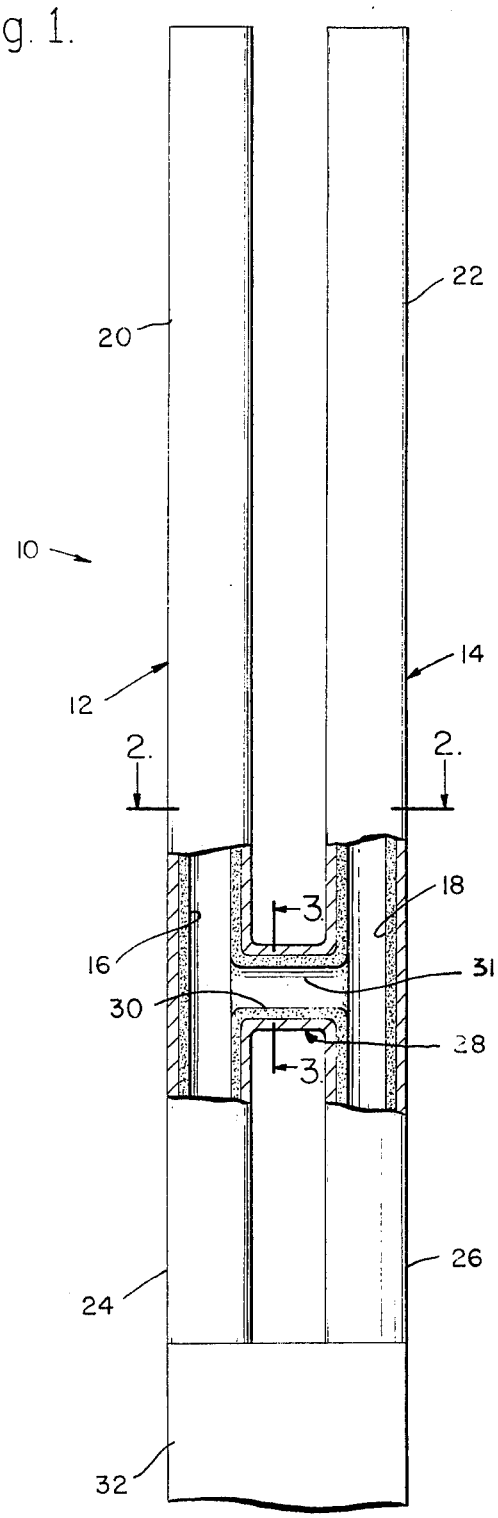
Fig. 2.
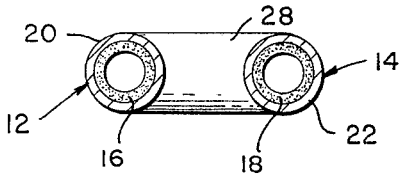
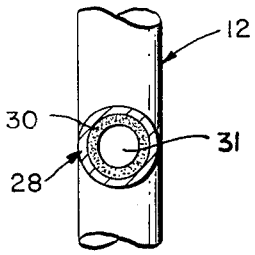
Fig. 3.

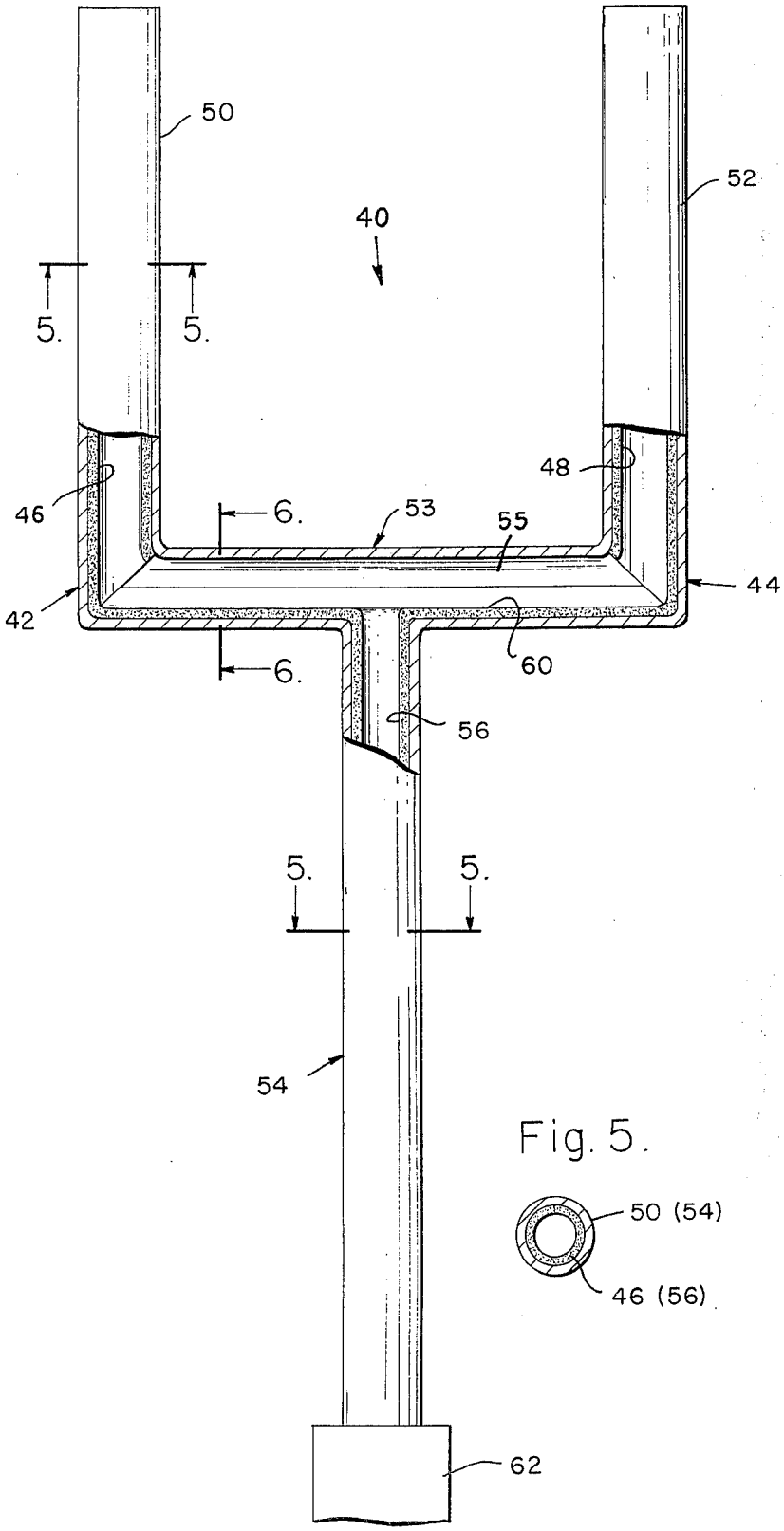
Fig. 4.
Fig. 5.
Fig. 6.
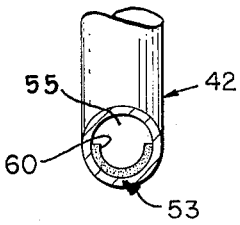

SWITCHABLE HEAT PIPE ASSEMBLY

BACKGROUND OF THE INVENTION

1. Field of the Invention

The present invention relates to a heat pipe assembly for thermally coupling a device to be cooled to the colder of two heat sinks while thermally isolating the device from the other.

2. Description of the Prior Art

Heat transfer devices generally include such conductors as copper red or pyrolytic carbon or a mechanically pumped refrigeration system which are generally expensive, heavy, and relatively inefficient as producing heat hysteresis with disturbance of the temperatures of the devices to be cooled. Two known devices are described in U.S. Pat. Nos. 3,776,304 and 3,818,980. In the former patent, the wick structure at a third heat transfer surface is hydraulically isolated from the wick structure in the evaporator, thus preventing transfer of the working fluid, as a fluid, between the third heat transfer surface and the evaporator. It further requires external electrical power or other means to accomplish control of the device. Furthermore, the mode of control is limited to either an on or off condition. In the latter patent, the heat pipe with wick is interconnected to a reservoir with wick by a conduit without wick in which the reservoir does not serve as a heat pipe itself; therefore, it comprises a single, unswitchable heat pipe.

SUMMARY OF THE INVENTION

The present invention overcomes or avoids the problems of these and other devices by providing for a heat pipe assembly having a switching capability by providing at least a pair of heat pipes, which respectively comprise separate or common evaporators, both coupled to separate condensers. The vapor spaces of the heat pipes are connected by means of a common tube construction to equalize the vapor pressure within the heat pipes. All heat pipes have wicks, but have sufficient fluid only to saturate a single pipe. Any heat applied to the condenser of any of the pipes causes such heat pipes to become inoperative since all of the fluid is transferred to the other cooler pipe or pipes which can operate with a lower thermal load. The thermal coupling changes with a minimum of hysteresis and little or no disturbance of the temperature of the devices to be cooled.

It is, therefore, an object of the present invention to provide for an improved switchable heat pipe assembly.

Another object is to provide for a relatively inexpensive heat pipe assembly.

Another object is to provide for such a heat pipe assembly of relatively light weight.

Another object of the present invention is to provide for a reliable heat pipe assembly.

Another object of the invention is to provide for minimum of heat hysteresis in devices to be cooled.

Another object of the present invention is to provide for little or no disturbance of the temperature of devices to be cooled by such heat pipe assemblies.

Other aims and objects as well as a more complete understanding of the present invention will appear from the following explanation of exemplary embodiments and the accompanying drawings thereof.

BRIEF DESCRIPTION OF THE DRAWINGS

FIG. 1 is an elevational view in partial cross-section of a first embodiment of the present invention, having an H-shaped configuration;

FIG. 2 is a view of the embodiment depicted in FIG. 1 taken along lines 2—2 thereof;

FIG. 3 is a view of the embodiment shown in FIG. 1 taken along lines 3—3 thereof;

FIG. 4 is an elevational view in partial cross-section of a second embodiment of the present invention, having a Y-shaped configuration;

FIG. 5 is a view of the embodiment of FIG. 4 taken along either of lines 5—5 thereof; and FIG. 6 is a view of the embodiment of FIG. 4 taken along line 6—6 thereof.

DESCRIPTION OF THE PREFERRED EMBODIMENTS

The present invention has been described, inter alia, in a paper entitled "Development Of A Switchable Cryogenic Heat Pipe For Infrared Cooling" presented at the AIAA/ASME 1974 Thermophysics and Heat Transfer Conference, July 15–17, 1974, Boston, Massachussetts and in Paper No. 74–751 published thereafter by the American Institute of Aeronautics and the American Society of Mechanical Engineers, both New York, N.Y., following this conference, the contents thereof being included herein as if set forth in haec verba.

Accordingly, with respect to FIGS. 1–3, a heat pipe assembly 10 is configured in an H-shape, comprising two separate heat pipes 12 and 14, each with its own wick structures 16 and 18. Each heat pipe 12 and 14 comprises condenser sections 20 and 22 and evaporator sections 24 and 26. A tubular segment 28, having a wick structure 30 and vapor space 31 therein, is connected only to evaporators 24 and 26 to allow for the communication of vapor and fluid. Evaporator sections 24 and 26 are coupled to one or more sources of heat 32, such as devices to be cooled, while condenser sections 20 and 22 are placed within a cooling or cold space for condensation of the working fluids.

Referring to FIGS. 4–6, a heat pipe assembly 40 is of Y-shape configuration comprising a pair of heat pipes 42 and 44 with wick material 46 and 48 respectively therein. Each heat pipe 42 and 44 comprises condenser sections 50 and 52 coupled by a common vapor space section 53, having a common vapor space 55 therein, to a common evaporator section 54. Section 54 is provided with wick material 56 therein. Wick structure 56 of common evaporator section 54 is coupled to wick structure 46 and 48 of condenser sections 50 and 52 by a common wick 60 in vapor space section 53 preferably of substantially U-shaped cross-section, as best shown in FIG. 6, although other cross-sectional shapes may be used. As in the embodiment of FIGS. 1–3, evaporator section 54 is coupled to a source of heat 62.

Suitable working fluid is placed within respective assemblies 10 and 40 shown in FIGS. 1–6 to the extent of sufficiently saturating only one of heat pipes 12, 14 or 42, 44.

As is known in the art, a heat pipe is a device that can transport thermal energy very efficiently by relying on the evaporation, condensation and surface tension characteristics of the working fluid. The properly designed heat pipe is able to transfer several hundred times more heat per unit weight than is a solid thermal conductor of the same cross-sectional area. Briefly, it is a closed chamber lined with a porous material or wick to provide a capillary structure. It contains a volatile fluid in sufficient quantity to saturate the porous lining or wick with little or no excess. The chamber may be of any shape. The operation of the heat pipe takes advantage of the latent heat of vaporization of the fluid. Heat applied to one portion of the wall evaporates the working fluid into the chamber. The vapor moves from the heated portion of the pipe to a cooler portion where it condenses to liquid. The liquid is absorbed into the wick and, by capillary action, flows to the hot end of the chamber to replace the liquid being evaporated. Thus, the process is one of continuous pumping through a cycle of evaporation, liquid transport through the wick, and re-evaporation.

In the design of heat pipes, there are several parameters which are basic, all depending upon working fluid properties. A chemically stable fluid having no reaction with heat pipe materials is imperative. High latent heat evaporation, density, surface tension and thermal conductivity accompanied by low viscosity are desirable properties for optimum heat pipe operations. Various suitable fluids include argon, methane, Freon 14, ethylene, ethane, Freon 23, and Freon 13, all of which are suitable for use in the present invention, among other fluids. With respect to the choice of the specific working fluid, its critical temperature must be higher than the operating temperature of the heat pipe to enable condensation to take place at the condenser section and the boiling of the fluid to take place at the evaporator section. The operating temperature must be higher than the triple point temperature of the working fluid to avoid the possible occurrence of freezing.

The wick material must be chosen in order to obtain the best performance, because the size of its capillary is inversely proportional to both the capillary action, or driving force of the flow, and the pressure drop of the fluid flowing through the wick. Thus, the capillary passages must be small enough to provide adequate capillary action, but large enough to allow a sufficient flow rate of the condensed liquid to pass through them. A preferred material is Dynalloy X7, trademark of Fluid Dynamics Incorporated, which comprises a type of stainless steel felt metal with a very uniform pore size, specifically of average core radius of 0.0005 inches and 80% void volume. Thus, it is a preferred material used in the present invention. It is to be understood, however, that other suitable wicking materials may be utilized.

In the embodiment of FIG. 1, for example, heat pipes 12 and 14 are connected at their evaporator sections 24 and 26 to allow for communication of vapor and fluid, and otherwise preventing communication between condenser sections 20 and 22. Heat pipe assembly 10 is charged with sufficient working fluid to fill only one of the heat pipes. In operation, any fluid in the evaporator sections evaporates and is driven into the cooler of the two condenser sections from which it returns through the wick to either evaporator section 24 or 26, as permitted by connecting wick structure 30. For example, condenser section 20 may temporarily be exposed to heat while condenser section 22 may be temporarily exposed to the cold. Thus, section 20 is dried out and the working fluid is transported to section 22 which then is operative to cool a device at heat source 32. Then, section 20 may be exposed to the cold while section 22 is exposed to heat, so that section 20 then becomes the operative condenser.

In the embodiment of FIGS. 4–6, wick structure 56 runs from evaporator 54 through wick structure 60 in common vapor space section 48 to each condenser 50 and 52. This common space is the primary distinguishing feature between that of the embodiment shown in FIGS. 1–3. In the Y-shape configuration, the heat pipe assembly is also charged with only enough working fluid to fill one of the wick structures, and switching between condenser sections 50 and 52 is achieved in the same manner as in the H-shape configuration, due to changing exposure to heat and cold.

Thus, it may be assumed that one or more devices at 32 or 62 is to be cooled and that either of condenser sections 20 and 22 or 50 and 52 are respectively exposed to heat and cold, as may occur in certain environments. For example, with respect to FIGS. 4–6, section 50 may be exposed to heat while section 52 be exposed to cold. Accordingly, only section 52 will operate to provide the heat pipe recycling between common evaporator section 54 and condenser section 52 with condenser section 50 being inoperative as being too hot. If it is to be assumed that the whole of the assembly of FIG. 1 rotates with respect to a space which may alternately be hot or cold, condenser sections 50 and 52, or 20 and 22, would be separated from one another sufficiently so that only one condenser section at a time would be exposed to the heat so that the other of condenser sections 20 and 22 may operate to cool the devices or apparatus at the source 32.

Although the invention has been described with reference to particular embodiments thereof, it should be realized that various changes and modifications may be made therein without departing from the spirit and scope of the invention.

What is claimed is:

1. A switchable heat pipe assembly comprising at least a pair of heat pipes, each of said heat pipes including a separate condenser section and means for defining one or more evaporator sections, means for providing communication between said separate condenser sections and to said evaporator sections means, first wick means in both said condenser sections for defining wick structures, second wick means in said evaporator sections means for defining a wick structure, third wick means in said communication means for defining a wick structure, said separate condenser sections being otherwise unconnected by wicking means, and means for defining working fluid in said heat pipes sufficient for saturating only one of said heat pipes.

2. A switchable heat pipe as in claim 1 wherein said evaporator sections means comprises a pair of separate evaporator sections coupled together by said communication means having said third wick structure means therebetween.

3. A switchable heat pipe as in claim 2 wherein said heat pipes have a substantially H-shaped configuration with a tubular segment therebetween for defining said communication means having said third wick structure therein.

4. A switchable heat pipe as in claim 1 wherein said evaporator section means comprises a common evaporator section coupled to said separate condenser sections by said communication means for defining a common vapor space having said third wick means therein.

5. A switchable heat pipe as in claim 4 wherein said pipes have a substantially Y-shaped configuration with said communication means having said third wick means therein.

6. A switchable heat pipe as in claim 5 wherein said third wick means has a substantially U-shaped cross-sectional configuration coupled only to said wick structure means of both said condenser sections and said wick structure means of said common evaporator section.

7. A switchable heat pipe assembly comprising at least two heat pipe condensers coupled to means for defining a heat pipe evaporation space, means for defining wicks therein, and means for defining working fluid therein sufficient for saturating only said wick means of one of said condensers and said evaporation space means.

* * * * *